US008151395B2

(12) United States Patent
Grötsch

(10) Patent No.: US 8,151,395 B2
(45) Date of Patent: Apr. 10, 2012

(54) MOTORIZED GOLF BALL CLEANING DEVICE

(76) Inventor: Markus Grötsch, Weiden (DE)

( * ) Notice: Subject to any disclaimer, the term of this patent is extended or adjusted under 35 U.S.C. 154(b) by 0 days.

(21) Appl. No.: 12/814,437

(22) Filed: Jun. 12, 2010

(65) Prior Publication Data

US 2011/0302730 A1 Dec. 15, 2011

(51) Int. Cl.
*A63B 47/04* (2006.01)

(52) U.S. Cl. ..... 15/21.2

(58) Field of Classification Search ..... 15/21.1, 15/21.2, 104.92, 160
See application file for complete search history.

(56) References Cited

U.S. PATENT DOCUMENTS

| | | | | | |
|---|---|---|---|---|---|
| 2,005,115 | A | * | 6/1935 | Stutz | 15/21.2 |
| 3,740,784 | A | | 6/1973 | Morrissey | |
| 4,899,413 | A | | 2/1990 | Trobiani | |
| 4,958,396 | A | * | 9/1990 | Butler et al. | 15/21.2 |
| 5,077,854 | A | * | 1/1992 | Moons | 15/21.2 |
| 5,139,577 | A | * | 8/1992 | Brock | 134/25.4 |
| 5,228,168 | A | * | 7/1993 | Hollrock et al. | 15/302 |
| 5,331,702 | A | * | 7/1994 | Willsey et al. | 15/21.2 |
| 5,542,440 | A | * | 8/1996 | Weimer et al. | 134/65 |
| 5,546,967 | A | * | 8/1996 | Weimer et al. | 134/65 |
| 5,647,082 | A | | 7/1997 | Garske et al. | |
| 5,711,330 | A | * | 1/1998 | Nelson | 134/133 |
| 5,772,778 | A | * | 6/1998 | Back | 134/6 |
| 5,806,122 | A | * | 9/1998 | Bogle et al. | 15/21.2 |
| 5,822,820 | A | * | 10/1998 | Heisler | 15/21.2 |
| 6,032,312 | A | * | 3/2000 | Hope et al. | 15/21.2 |
| 6,126,530 | A | * | 10/2000 | Hirata | 451/444 |
| 6,151,744 | A | * | 11/2000 | Ohtani et al. | 15/88.2 |
| 6,269,509 | B1 | * | 8/2001 | Mays | 15/21.2 |
| 6,553,598 | B1 | * | 4/2003 | Sansotta | 15/21.2 |
| 6,594,845 | B1 | * | 7/2003 | Hyatt et al. | 15/88 |
| 6,643,881 | B1 | * | 11/2003 | Shim | 15/21.2 |
| 7,389,556 | B2 | * | 6/2008 | Parton | 15/21.2 |
| 2008/0000036 | A1 | * | 1/2008 | Yun | 15/21.2 |
| 2008/0060147 | A1 | | 3/2008 | Parton | |

* cited by examiner

*Primary Examiner* — Mark Spisich
*Assistant Examiner* — Michael Jennings
(74) *Attorney, Agent, or Firm* — Smartpat PLC; Axel Nix

(57) ABSTRACT

Disclosed is a motorized golf ball cleaning device which comprises: a lower housing with a cavity for holding a liquid; an upper housing which contains electrical components, control components, and cleaning brushes; means to connect the upper housing to the lower housing; a feeder capable of holding a golf ball and feeding it into the liquid; a stand which is connected to the bottom of the lower housing; and means for powering the cleaning brushes.

18 Claims, 12 Drawing Sheets

MOTORIZED GOLF BALL CLEANING DEVICE

TECHNICAL FIELD

The present invention generally relates to a golf ball cleaning device, and more particularly, to a battery powered motorized golf ball cleaning device.

BACKGROUND OF THE INVENTION

Stand-alone golf ball washers are available at virtually every golf course. It is commonplace to find at least one golf ball washer before each hole on a golf course, in close proximity to the tee box. In fact, from exclusive country clubs to public par-three courses, golfers expect to find a golf ball washer on every hole.

Common single golf ball washers for use on golf courses are manually operated, such as the one disclosed in U.S. Pat. No. 5,647,082, which is hereby incorporated by reference thereto in its entirety.

An exemplary battery-powered golf ball cleaning device is disclosed in U.S. Pat. No. 6,269,509 which is hereby incorporated by reference thereto in its entirety.

SUMMARY OF THE INVENTION

Disclosed is a motorized golf ball cleaning device (herein referred to as the device), which is configured to automatically clean a single golf ball. The device is enclosed within a housing. The housing may comprises an upper and a lower housing, which are openably connected to one another. The lower housing comprises a cavity for holding a cleaning fluid. The device may be opened for replenishing or replacing the cleaning fluid, e.g. by separating the upper housing from the lower housing or pivoting the upper housing against the lower housing. Two brushes are provided which partially or completely immerse into the cleaning fluid. The brushes are operatively connected to electric motors which cause the brushes to rotate during cleaning operation. A feeder feeds the golf ball from an entry guide on the outside of the upper housing through a feeder channel to a cleaning position between the brushes. During cleaning operation the feeder holds the golf ball in the cleaning position between the rotating brushes, allowing the ball to spin and be cleaned from all sides. The presence of a golf ball in the cleaning position is detected by a sensor, which is operatively connected to a control unit that controls power to the electric motors. If a golf ball is detected in the cleaning position the control unit activates the electric motors for a predetermined amount of time that is sufficiently long to clean a spoiled golf ball.

In an exemplary embodiment the cavity of the lower housing may be configured to accept a removable reservoir which contains the cleaning fluid. The reservoir may comprise handles, allowing the reservoir to be removed from the cavity, so that old cleaning fluid and dirt which has collected in the reservoir can be easily poured out. The reservoir holds about 3.5 to 4.0 liter of cleaning fluid.

Each brush may be operatively connected to the motor by a gear set, allowing the electric motor to rotate faster than the brush. The gear sets, motors and brushes may form a cleaning mechanism assembly, which is mounted to the upper housing.

The device may be powered by a battery, which is operatively connected to the control unit, and which provides energy to power the electric motors during a cleaning operation. Preferably, the battery is rechargeable. The device may further comprise a solar cell array capable of generating enough power to charge the rechargeable battery between cleaning operations, thus eliminating the need for an external power source for the device. The rechargeable battery may have a capacity of about 3.2 Ah, which has proven to be sufficient for approximately 1500 cleaning operations.

A sensor capable of detecting the presence of a golf ball in the cleaning fluid may be operatively connected to the control unit. The sensor may comprise a reed contact, which switches when the feeder is in its fully inserted position. It may further comprise a light guide which is interrupted by the presence of a golf ball in the cleaning device. The control unit may be an electronic circuit comprising a timer for activating the electric motors for a predetermined time after a golf ball has been detected in the cleaning position, i.e. when the feeder is fully inserted. The control unit may also comprise a charge control circuit for controlling the charging of the rechargeable battery through the solar cell array.

The cleaning brushes may be mounted on the upper housing so that they are partially immersed in the cleaning fluid when the device is closed and operational. The cleaning brushes may be easily accessible, so that they can be replaced when worn. Scrubbing cleaning brushes having an essentially horizontal rotational axis may be used.

Alternatively, scrubbing brushes having a vertical axis may be used. In vertical embodiments both scrubbing brushes may be powered by one electric motor, and a shaft may be used between both brushes. In such an embodiment only the lower brush may be in contact with cleaning fluid.

The upper housing may be connected to the lower housing by one or more hinges combined with a gas spring. The hinge or hinges enable opening and closing of the device. The gas spring keeps the device open during maintenance functions. Positive force must be used to overcome the resistance of the gas spring and close the device. A lock may be provided to secure the upper housing in its closed position and prevent unauthorized access to the inside of the device.

The feeder is capable of holding a golf ball and feeding it into the cleaning fluid. The feeder comprises a receptacle hole for the golf ball at its lower end, the diameter of which is slightly larger than 1.68 inches, the diameter of a golf ball. This allows the golf ball to spin within the receptacle hole during cleaning, so that it is cleaned from all sides. The cross section of the feeder at the receptacle hole may be oval. The larger diameter of the cross section is being referred to as the feeder's height, the smaller diameter of the cross section perpendicular to the larger diameter is being referred to as the feeder's width. The feeder is configured such that its receptacle hole its width is shorter than 1.68 inches and its height is longer than 1.68 inches.

In order to clean a golf ball a golfer manually inserts the golf ball into the feeder mechanism, which extends through the housing to the cleaning mechanism inside the device. Then, the golfer manually pushes the feeder into its cleaning position, where the golf ball is automatically cleaned by brushes of the cleaning mechanism, which at least partially immerse in the cleaning fluid. After the cleaning brushes have stopped or earlier, if the golfer expects his ball to be sufficiently clean, the golfer removes the golf ball from the device by pulling the feeder.

The device may be mounted on top of a stand, which may be a pre-existing stand used to hold a previously existing manual golf ball washer or a pipe stand designed specifically for the device.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly. The following detailed description of the invention is merely exemplary in nature and is not intended to limit the invention or the application and uses of the invention. Furthermore, there is no intention to be bound by any theory presented in the preceding background of the invention or the following detailed description of the invention.

DETAILED DESCRIPTION

Golf ball washers serve a relatively basic function; namely to remove dirt and other debris from the surface of a golf ball which might otherwise affect the trajectory, distance, etc. of the golf ball after being struck. To accomplish this purpose, stand-alone golf ball washers come in many different forms.

In addition to the basic golf ball washing device, a towel is often attached to the exterior of the device and is used by the golfer to dry the golf ball after being washed. Other useful devices, such as golf shoe spike cleaners, garbage cans, score card holders, hole descriptions, advertisements, etc., can also be affixed to the device.

The elements of a basic golf ball washer are a tank to retain cleaning fluid, brushes located in the tank and capable of cleaning a golf ball, and an agitator mechanism which holds the golf ball while a golfer maneuvers the golf ball to enable the brushes and cleaning fluid to clean the golf ball. With a basic golf ball washer, the golfer generates all of the mechanical action. This can result in incomplete cleaning of the golf ball since the golfer may not have the patience or experience to clean the golf ball properly. Hence, a need exists for golf ball washer which provides all of the mechanical action necessary to properly clean the golf ball. The present disclosure describes a motorized golf ball cleaning device (herein referred to as the device) which overcomes the limitations of a manual golf ball cleaning device.

Figure 1:
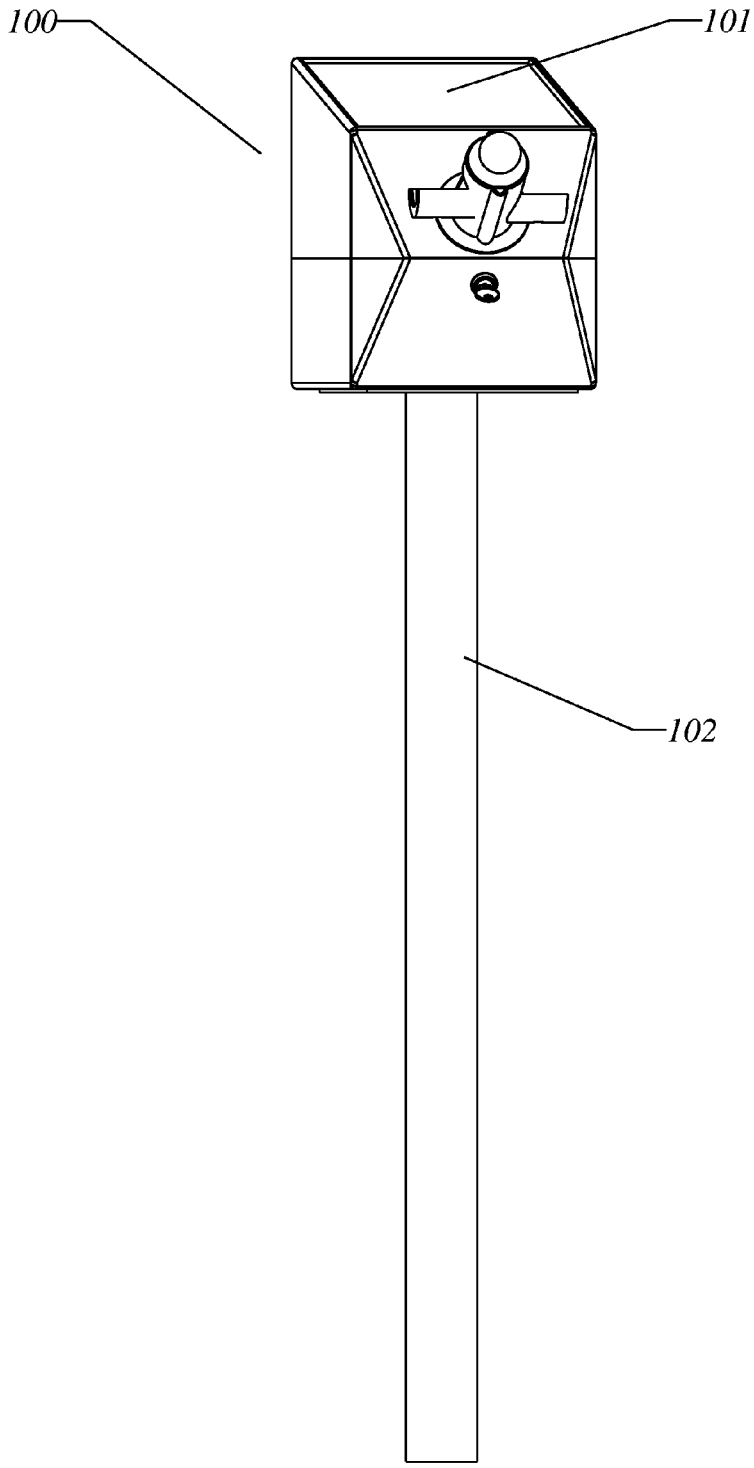
FIG. 1 shows the motorized golf ball cleaning device in a closed state.

Referring to FIG. 1 the motorized golf ball cleaning device 100 is illustrated in a closed state. The top surface is a photovoltaic solar cell array 101, which powers the device. The solar cell array 101 is operatively connected to a rechargeable battery (not shown) which stores energy for later use. A charge control circuit may be used to control the charging of the rechargeable battery by the solar cell array 101. A pipe-stand 102 can be a pre-existing stand which was used for a previously existing golf ball washer or a new pipe-stand designed specifically for the device.

Figure 2:
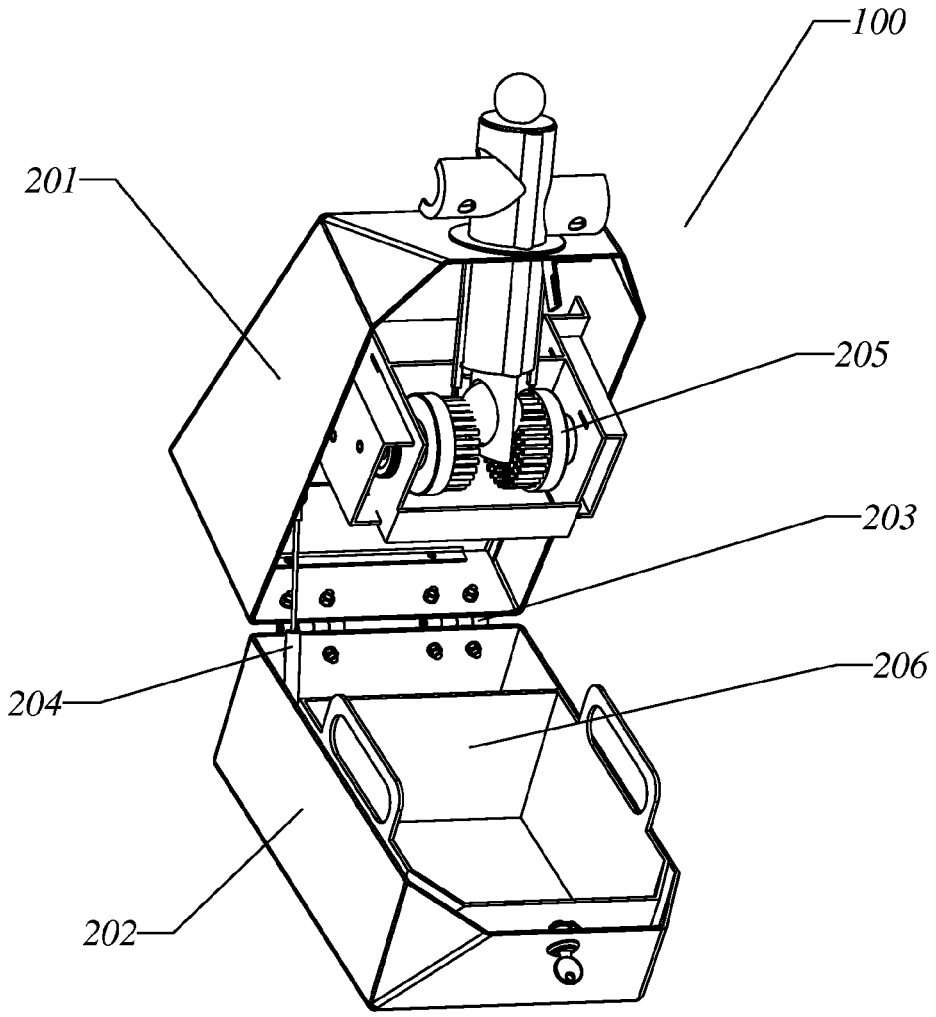
FIG. 2 shows the motorized golf ball cleaning device in an open state.

FIG. 2 shows the motorized golf ball cleaning device 100 in an open state. The upper housing 201 and lower housing 202 are shown pivotably connected with two hinges 203. The hinges 203 enable the upper housing 201 to pivot into an open position. A gas pressure spring 204 holds the device in the open position. Cleaning brushes 205 are mounted to the upper housing 201. The lower housing 202 holds cleaning fluid within a removable reservoir 206. More specifically, the lower housing 202 and removable reservoir 206 are configured to hold about 3.5 to 4 liter of cleaning fluid. When the device is closed, the cleaning brushes 205 immerse about half-way into the cleaning fluid 206. While the upper housing 201 and lower housing 202 are illustrated as having about similar size it should be understood, that many alternatives housings exist to enclose the motorized golf ball cleaning device; the upper housing may e.g. be formed as a substantially flat top cover.

Figure 3:
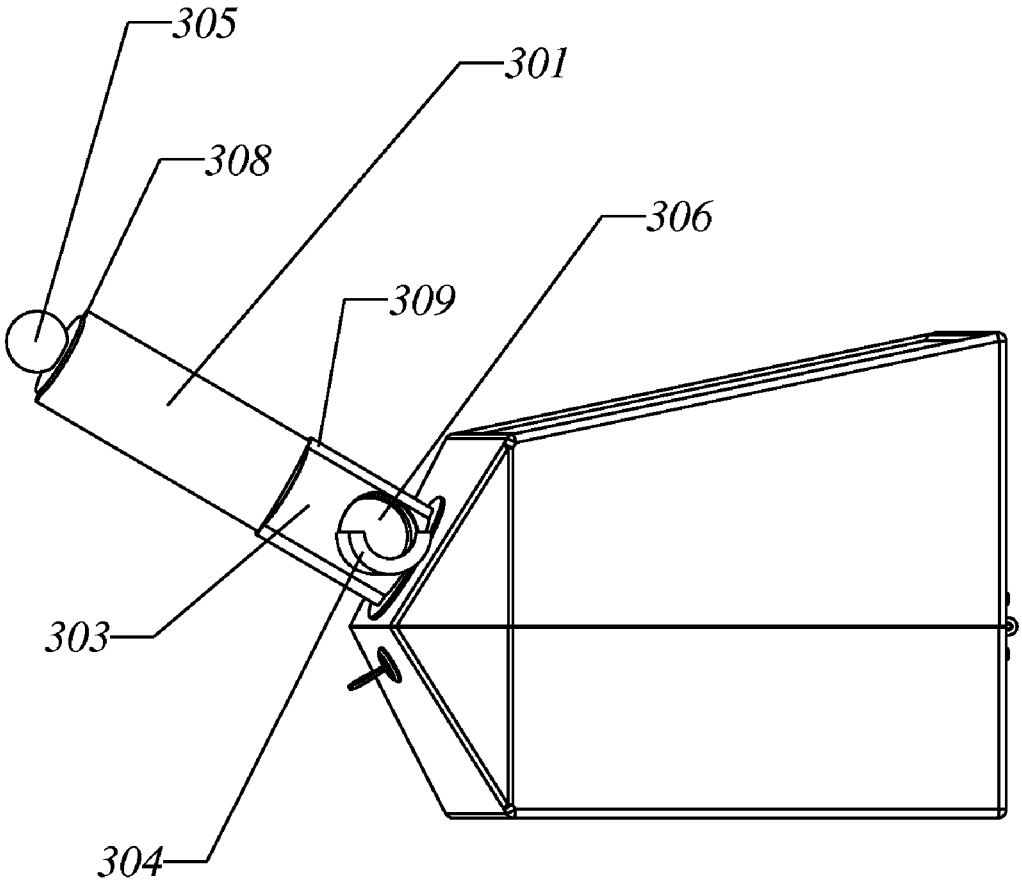
FIG. 3 shows the device just prior to the insertion of a golf ball.

FIG. 3 shows the device just prior to the insertion of a golf ball. A feeder 301 is in an open position. Feeder 301 is substantially formed as an elongated member that can slide up and down within a feeder channel 303. The largest diameter of feeder 301 is larger than that of a golf ball. Feeder 301 comprises guidance protrusions 308 along its longitudinal extension, which engage corresponding guidance indentations 309 of feeder channel 303. The guidance protrusions 308 and guidance indentations 309 prevent feeder 301 from rotating within feeder channel 303. The feeder 301 incorporates a knob 305 for manual ease of use. The lower end of feeder 301 comprises a receptacle hole 310 for a golf ball.

Figure 3A:
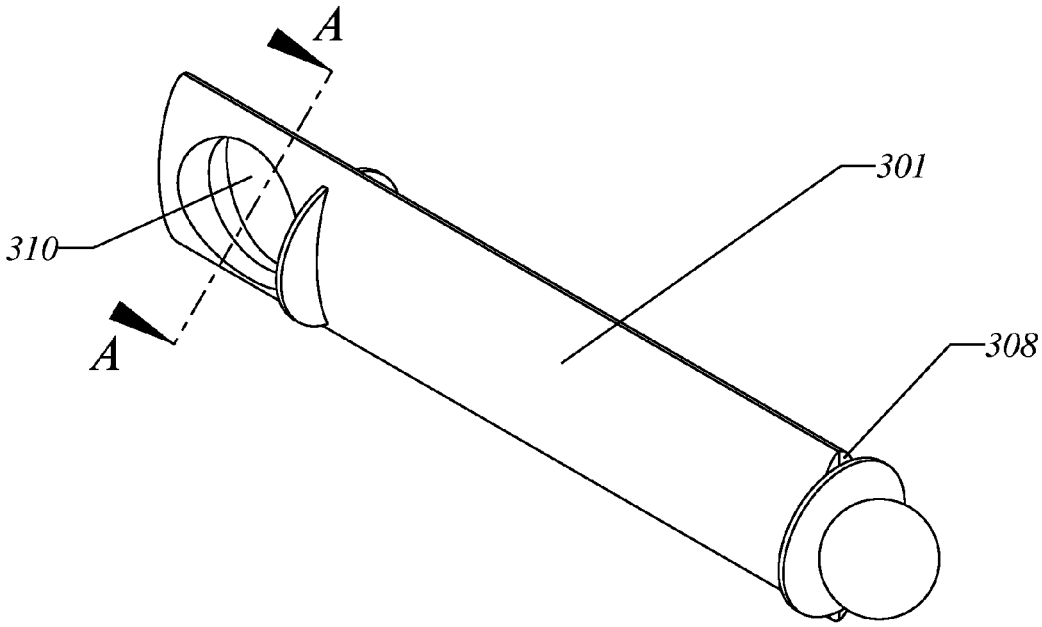
FIG. 3A shows an isometric view of the feeder.
Figure 3B:
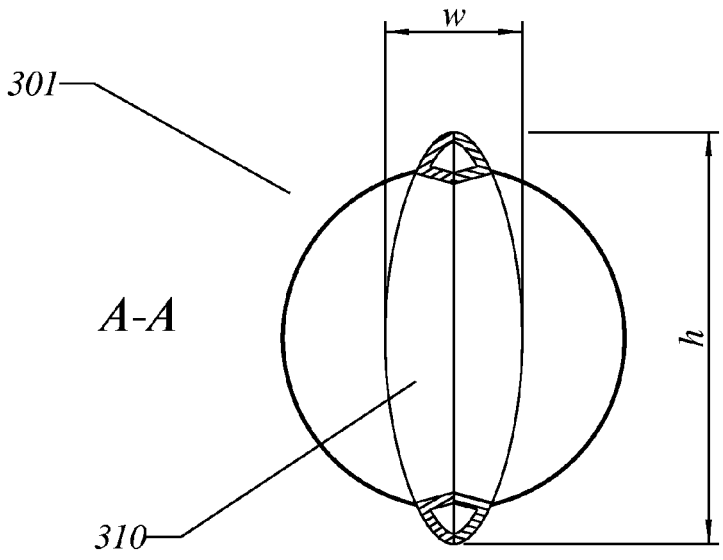
FIG. 3B shows a cross section of the feeder at its receptacle hole.

An exemplary feeder 301 is illustrated in FIG. 3A and a cross section A-A through the feeder 301 is shown in FIG. 3B. The cross-sectional shape of feeder 301 in the area of the golf ball receptacle hole 310 is substantially elliptical. Height h of the cross section is longer than the diameter of a golf ball 302, which is illustrated in broken line. Width w of the cross section is shorter than the diameter of a golf ball. The elliptical shape maintains the function of guidance protrusions 308, and provides room for brushes 205 to contact golf ball 302 within receptacle hole 310.

Referring back to FIG. 2 a golf ball 302 is fed into the feeder 301 through an entry opening 306 in feeder channel 303. Feeder channel 303 guides the golf ball 302 to its cleaning position between brushes 205. A golf ball entry guide 304 is sloped toward the entry opening 306. The golf ball 302 can be placed in the golf ball entry guide 304 and gravity is used to roll the golf ball 302 through entry opening 306 into the feeder channel 303. Conversely, a golf ball exit guide (not shown) is located opposite and above the golf ball entry guide 304. Feeder 301 and feeder channel 303 may be comprised within a feeder mechanism assembly.

Figure 4:
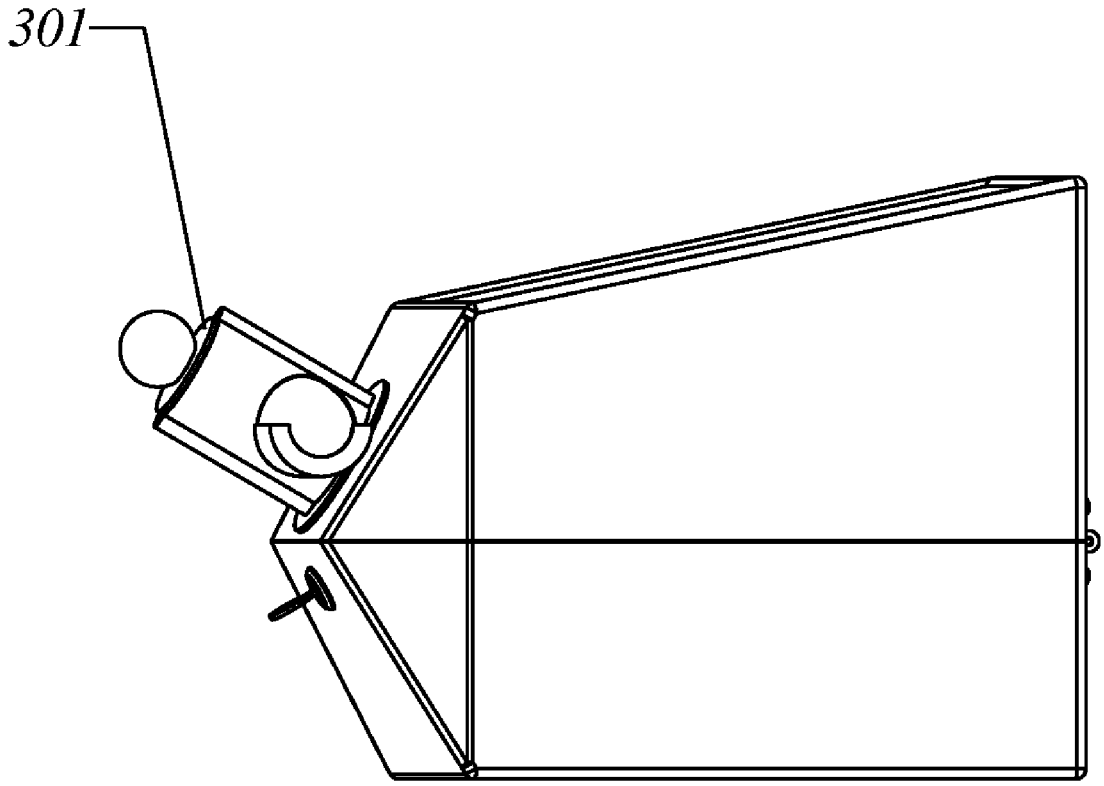
FIG. 4 shows the device with the feeder in a closed position.

FIG. 4 shows the device with the feeder 301 in a closed position. The feeder 301 has been manually pushed into cleaning position. If a golf ball has been inserted, the feeder 301 will hold the golf ball in position between the cleaning brushes so that it can be cleaned.

Figure 5:
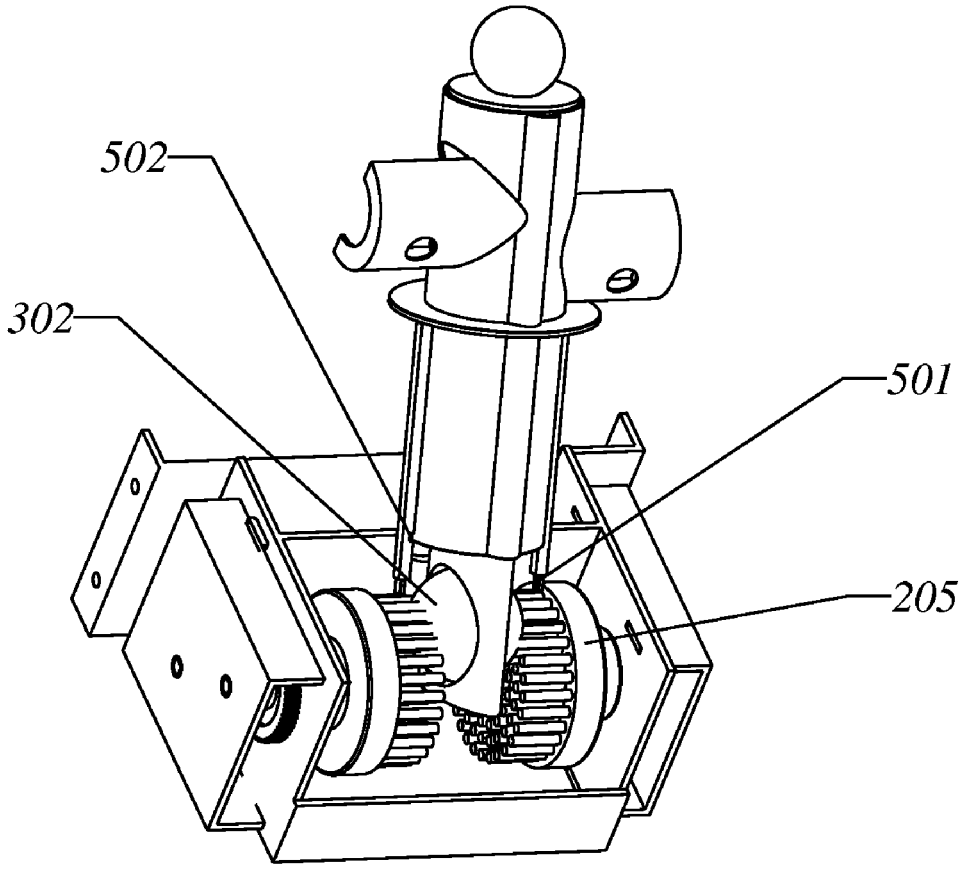
FIG. 5 shows the golf ball in cleaning position.

FIG. 5 shows the golf ball 302 in cleaning position. The cleaning brushes 205 are activated for about 8 seconds, once the golf ball 302 reaches cleaning position. Experiments show that 5 seconds of cleaning with the cleaning brushes 205 is usually sufficient to clean the golf ball 302, and often 2-3 seconds are sufficient to clean a lightly spoiled ball. The brushes 205 are partially immersed in cleaning fluid (not shown). A reed contact 502 is used to detect that feeder 301 is in its fully inserted cleaning position. Feeder 301 comprises a magnet (not shown) that activates reed contact 502 when feeder 301 is in the cleaning position. A light guide or ultrasonic sensor 501 is used to detect the presence of the golf ball 302 in the receptacle hole 310 in cleaning position. The cleaning brushes 205 are only activated if the golf ball 302 is in cleaning position. The cleaning brushes 205 are automatically stopped after the maximum activation time (typically 8 seconds) or when the golf ball 302 is removed from its cleaning position. To minimize the electric current consumption light guide or ultrasonic sensor 501 are activated briefly when reed contact 502 indicates that feeder 301 has reached the cleaning position but are otherwise turned off.

Figure 6:
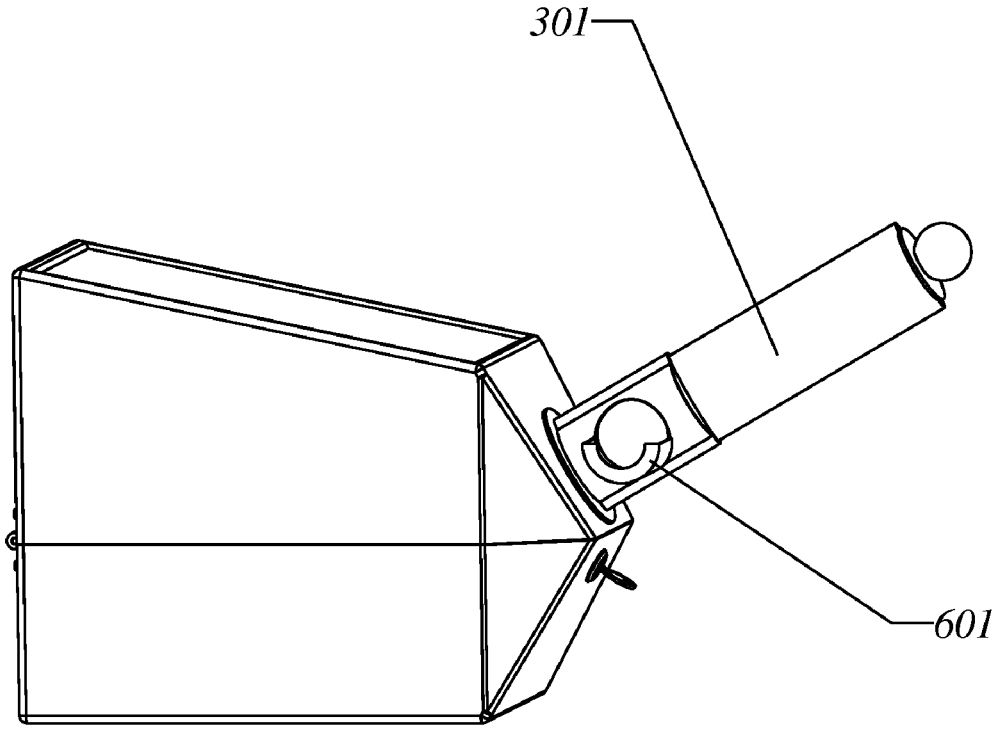
FIG. 6 shows the device with the feeder in open position and a golf ball being extracted.

FIG. 6 shows the device with the feeder in open position and a golf ball being extracted. The feeder 301 has an end stop to prevent being pulled out too far. A golf ball exit guide 601 enables the ball to roll out of the feeder 301 via gravity. The golf ball exit guide 601 is located opposite and above the golf ball entry guide (not shown).

Figure 7:
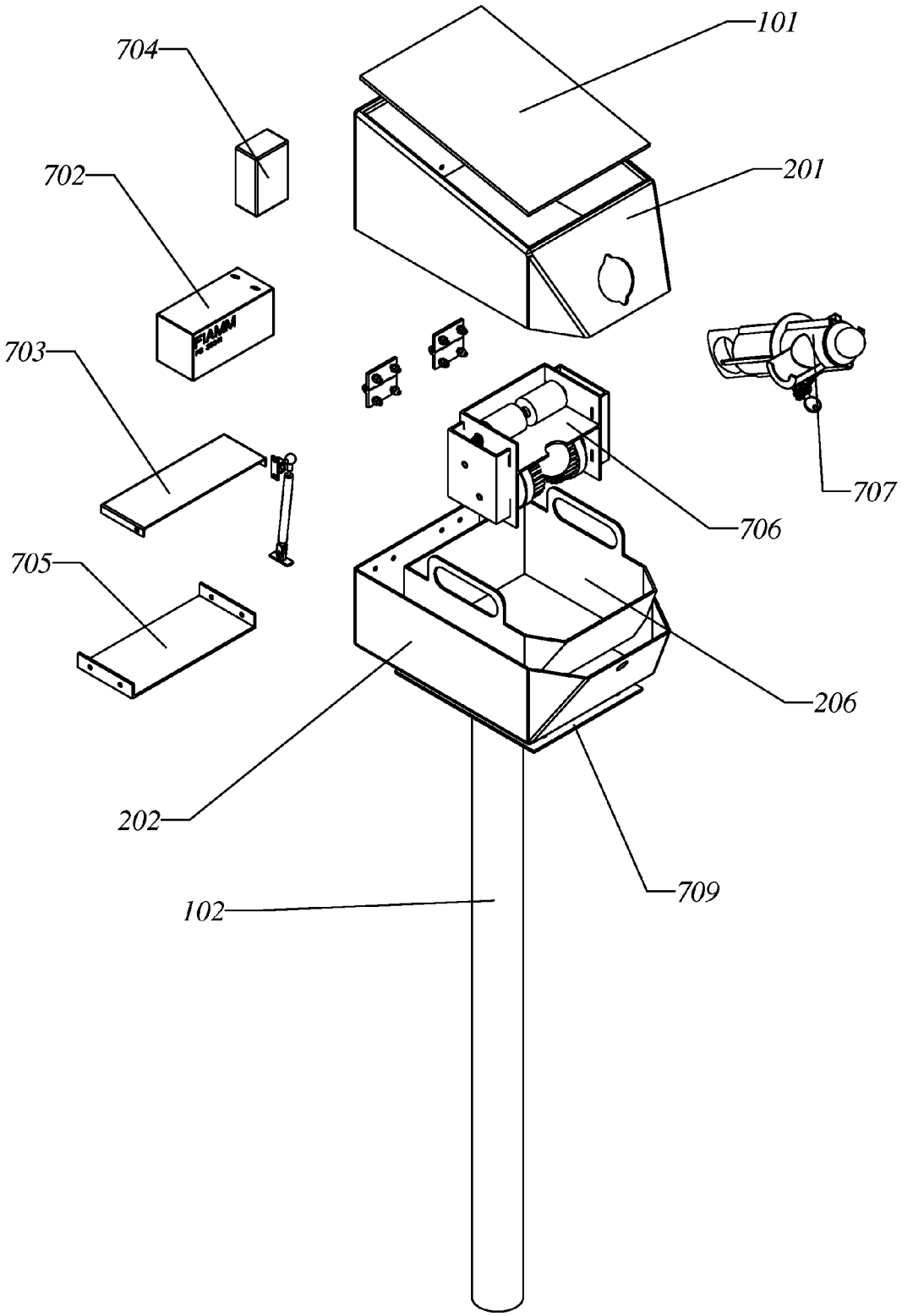
FIG. 7 shows an exploded view of the device.

FIG. 7 shows an exploded view of the device. The solar cell array 101 is mounted on top of the upper housing 201. Mounted within the upper housing 201 are a rechargeable battery 702, rechargeable battery and control unit mounting bracket 703, control unit 704, cleaning mechanism mounting bracket 705, cleaning mechanism assembly 706, and feeder mechanism assembly 707. The upper housing 201 detachably connects to the lower housing 202. Located within the lower housing 202 is a removable reservoir 206 capable of holding cleaning fluid. The lower housing 202 is attached to a stand mounting plate 709. The stand mounting plate 709 is attached to a pipe-stand 102. Rechargeable battery 702 may be a lead acid battery, NiCad battery, LiIon battery, ultra-capacitor or any other device suitable for storing electric energy. A capacity of approximately 3.2 Ah, which is sufficient for approximately 1500 cleaning operations, has been found to be beneficial.

In an alternative embodiment removable reservoir 206 may be omitted, and cleaning fluid may be held directly in lower housing 202. To remove cleaning fluid and dirt a drain including a valve of stopper is connected to the bottom of lower housing 202.

Figure 8:
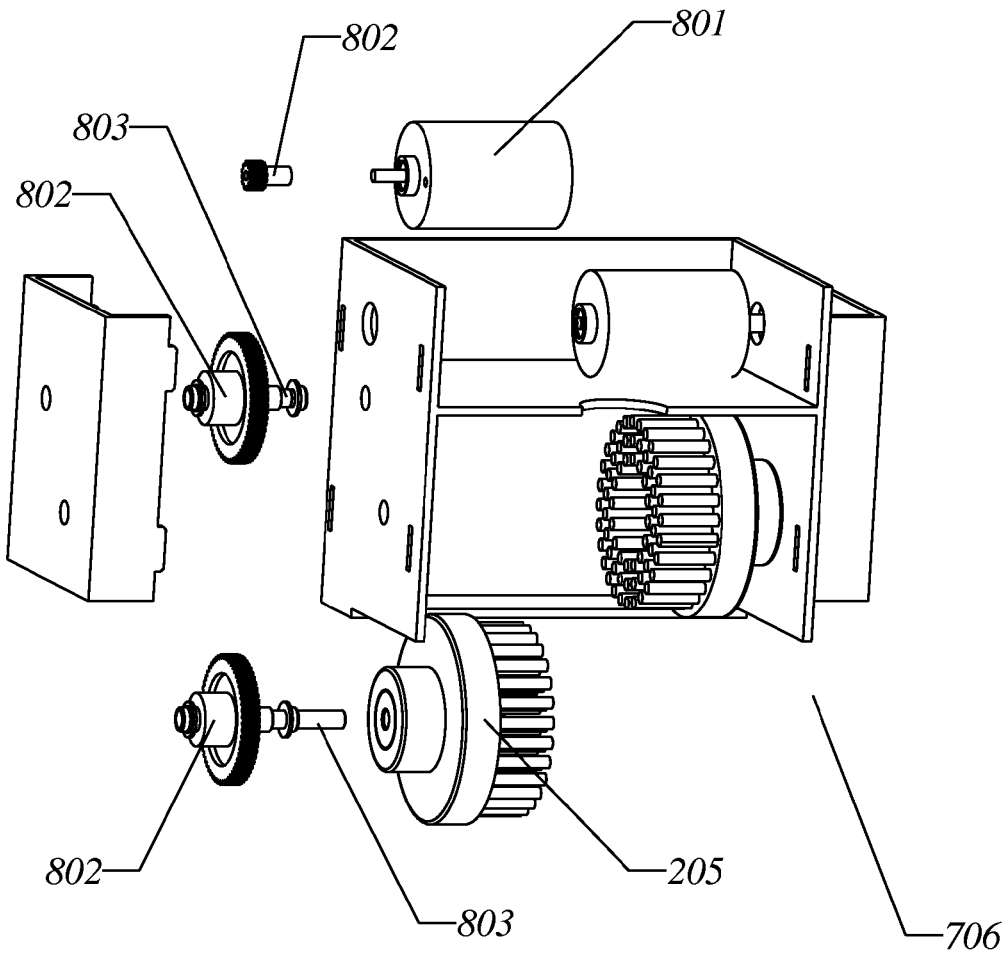
FIG. 8 shows an exploded view of a cleaning mechanism assembly.

FIG. 8 shows an exploded view of a cleaning mechanism assembly 706. The cleaning mechanism assembly 706 contains a pair of motors 801, which convert electrical energy to mechanical energy. Each motor 801 drives its respective gear set 802. Each gear set drives its respective gear shaft 803, which turns its respective cleaning brush 205. Gears set 802 may be formed by several gear wheels as shown, but might also be formed as a chain and sprocket or belt drive.

Figure 9:
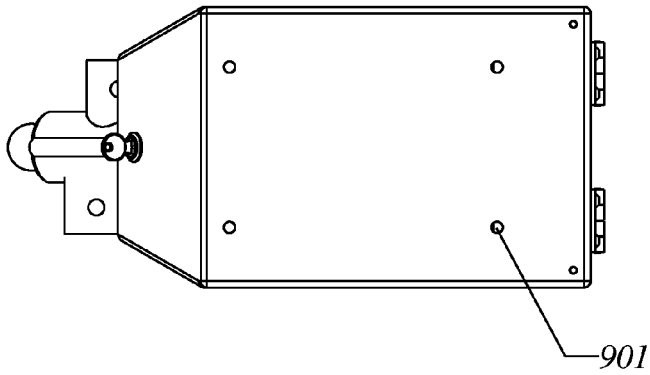
FIG. 9 shows a bottom view of the device.

FIG. 9 shows a bottom view of the device. Four mounting holes 901 are shown. Each mounting hole is capable of holding a bolt when the stand mounting plate 709 is connected to the bottom of the device with bolts.

Figure 10:
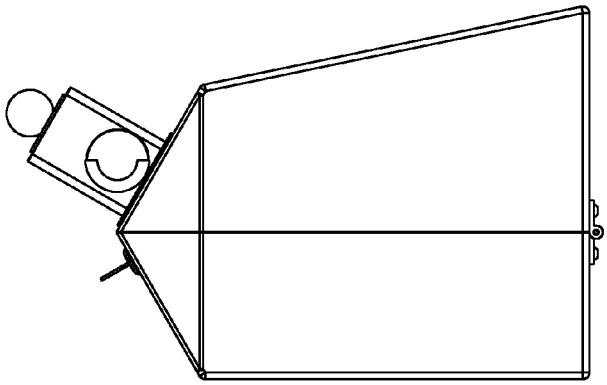
FIG. 10 shows a side view of the device.

FIG. 10 shows a side view of the device.

Figure 11:
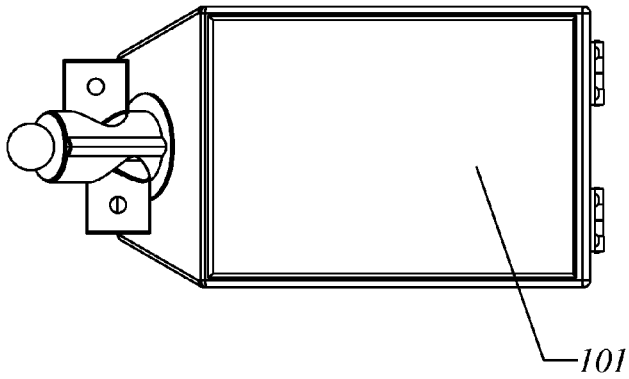
FIG. 11 shows a top view of the device.

FIG. 11 shows a top view of the device. Solar cell array 101 is identified.

Figure 12:
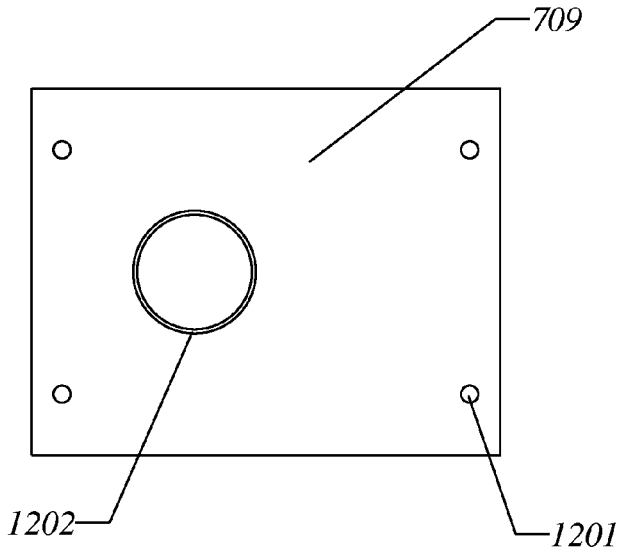
FIG. 12 shows the stand mounting plate.

FIG. 12 shows the stand mounting plate 709. The plate 709 has four mounting holes 1201 and a pipe-stand hole 1202.

Figure 13:
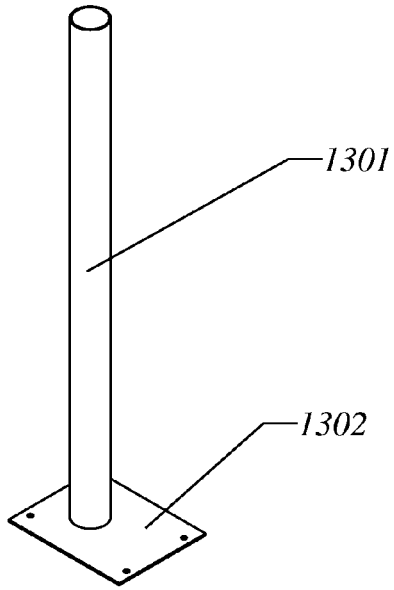
FIG. 13 shows the pipe-stand.

FIG. 13 shows the pipe-stand. The elements of the pipe-stand comprise: a pipe 1301 to maintain a proper height for the device; and a foot 1302 to stabilize the device and keep it vertical.

Figure 14:
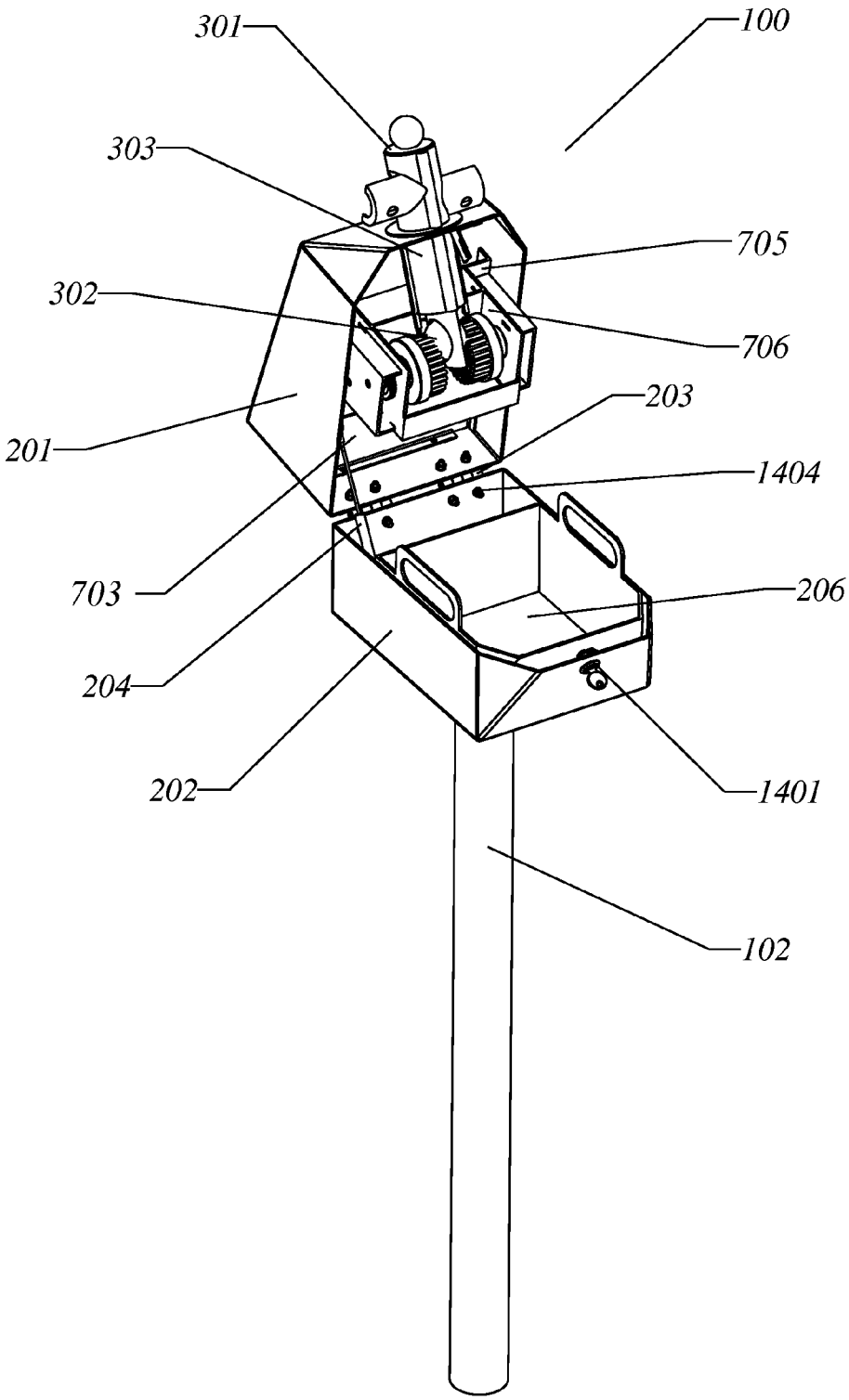
FIG. 14 shows an isometric view of the device in an open state.

FIG. 14 shows an isometric view of the device 100 in an open state. The upper housing 201 is connected to the lower housing 202 with hinges 203. The reservoir 206 is placed in the cavity of the lower housing 202. The cleaning mechanism assembly 706 is mounted within the upper housing 201. A lock 1401 is used to secure the device when it is closed and prevent unauthorized opening of the device. A mounting plate 705 is used to secure device components to the upper housing 201. The gas pressure spring 204 holds the device in an open position. The feeder 301 integrates the feeder channel 303 to hold the golf ball 302. A back mounting plate 703 helps to further secure device components to the upper housing. The pipe 1301 of a pipe-stand is shown attached to the lower housing 202. Fastener assemblies 1404 comprising a screw, washer, and nut are used at various locations on the device to secure components.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

What is claimed is:

1. A motorized golf ball cleaning device comprising:

a lower housing having a cavity for holding a cleaning fluid;

an upper housing connected to the lower housing;

two brushes for cleaning a golf ball, the brushes being operatively connected to at least one electric motor;

a control unit operatively connected to the at least one electric motor, to a battery, and to a sensor, wherein the sensor is configured to detect the presence of the golf ball in a cleaning position between the brushes;

a feeder channel extending through the upper housing to the cleaning position between the brushes; and a feeder configured to slide within the feeder channel and feed the golf ball through the feeder channel from outside the motorized golf ball cleaning device to the cleaning position between the brushes, wherein the control unit activates the at least one electric motor for a predetermined amount of time after the sensor detects the golf ball in the cleaning position, and wherein the golf ball remains in the cleaning position substantially stationary while being cleaned.

2. The motorized golf ball cleaning device as in claim 1, further comprising a removable reservoir for holding the cleaning fluid, the removable reservoir being placed in the cavity of the lower housing.

3. The motorized golf ball cleaning device as in claim 1, wherein the lower housing comprises a drain for removing cleaning fluid therefrom.

4. The motorized golf ball cleaning device as in claim 1, wherein the battery is rechargeable.

5. The motorized golf ball cleaning device as in claim 4, further comprising a solar cell array for charging the battery.

6. The motorized golf ball cleaning device as in claim 1, wherein gear sets are provided to operatively connect the brushes with the at least one electric motor.

7. The motorized golf ball cleaning device as in claim 6, wherein the brushes, gear sets and at least one electric motor are contained within a cleaning mechanism assembly, which is attached to the upper housing.

8. The motorized golf ball cleaning device as in claim 1, wherein the sensor comprises one or more components selected from the group consisting of a reed contact, a contact switch, a light guide and an ultrasonic sensor.

9. The motorized golf ball cleaning device as in claim 1, wherein the upper housing is openably connected to the lower housing by one or more hinges.

10. The motorized golf ball cleaning device as in claim 1, wherein the feeder is configured to hold the golf ball in the cleaning position while the golf ball is being cleaned.

11. The motorized golf ball cleaning device as in claim 1, wherein the feeder comprises guidance protrusions along it's longitudinal extension which engage corresponding guidance indentations in the feeder channel.

12. The motorized golf ball cleaning device as in claim 1, wherein the feeder comprises a receptacle hole for the golf ball, and wherein the cross section of the feeder at the receptacle hole has a width smaller than 1.68 inches and a height larger than 1.68 inches, and wherein the golf ball is fed from outside the motorized golf ball cleaning device to the cleaning position between the brushes by sliding the feeder within the feeder channel while the golf ball is retained within the receptacle hole.

13. A motorized golf ball cleaning device comprising:

a housing;

a feeder mechanism extending through the housing to a cleaning mechanism within the housing, the feeder mechanism comprising an elongated feeder member having a receptacle hole for a golf ball and a feeder channel extending through the housing to the cleaning mechanism, wherein the elongated feeder member is configured to slide within the feeder channel;

an electric motor configured to drive the cleaning mechanism;

a switch configured to detect the presence of a golf ball in the cleaning mechanism; and a stationary cleaning position for the golf ball at the cleaning mechanism, where the golf ball is cleaned without translational movement with respect to the cleaning mechanism, wherein the feeder mechanism is configured to feed a single golf ball into the cleaning mechanism, and wherein the cleaning mechanism is automatically activated for a predetermined amount of time by the switch.

14. A motorized golf ball cleaning device as in claim 13, wherein the cleaning mechanism comprises a brush, the brush being operatively connected to the electric motor, wherein the housing comprises a cleaning fluid, and wherein the brush is at least partially immersed within the cleaning fluid.

15. A motorized golf ball cleaning device as in claim 13, further comprising a magnet disposed at the elongated feeder member and wherein the switch comprises a reed contact configured to be activated by the magnet at the elongated feeder member when the elongated feeder member is fully inserted into the feeder channel.

16. A motorized golf ball cleaning device as in claim 13, wherein the switch is activated when the elongated feeder member is fully inserted into the feeder channel.

17. A motorized golf ball cleaning device comprising:

a housing;

a feeder mechanism extending through the housing to a cleaning mechanism within the housing, the cleaning mechanism comprising a first electric motor operatively connected to a first brush and a second electric motor operatively connected to a second brush;

a switch configured to detect the presence of a golf ball in the cleaning mechanism; and a stationary cleaning position for the golf ball at the cleaning mechanism, where the golf ball is cleaned without translational movement with respect to the cleaning mechanism, wherein the feeder mechanism is configured to feed a single golf ball into the cleaning mechanism, and wherein the cleaning mechanism is automatically activated for a predetermined amount of time by the switch.

18. A motorized golf ball cleaning device comprising:

a housing;

a feeder mechanism extending through the housing to a cleaning mechanism within the housing;

an electric motor configured to drive the cleaning mechanism;

a switch configured to detect the presence of a golf ball in the cleaning mechanism;

a stationary cleaning position for the golf ball at the cleaning mechanism, where the golf ball is cleaned without translational movement with respect to the cleaning mechanism;

a rechargeable battery configured to provide energy to power the cleaning mechanism; and a solar cell array configured to charge the rechargeable battery, thereby eliminating the need for an external power source for the device, wherein the feeder mechanism is configured to feed a single golf ball into the cleaning mechanism, and wherein the cleaning mechanism is automatically activated for a predetermined amount of time by the switch.

* * * * *